United States Patent [19]

Wanek

[11] 4,141,110

[45] Feb. 27, 1979

[54] HINGE ARRANGEMENT

[76] Inventor: Ronald G. Wanek, 423 Cleveland St., Arcadia, Wis. 54612

[21] Appl. No.: 669,224

[22] Filed: Mar. 22, 1976

[51] Int. Cl.[2] ..... E05D 5/02

[52] U.S. Cl. ..... 16/158

[58] Field of Search ..... 16/158, 159, 135, 149, 16/128 R, 138, 140

[56] References Cited

U.S. PATENT DOCUMENTS

| | | | |
|---|---|---|---|
| 1,124,048 | 1/1915 | Malaspina | 16/158 |
| 2,182,548 | 12/1939 | Bash | 16/158 |
| 2,929,093 | 3/1960 | Conlee | 16/140 |
| 3,153,807 | 10/1964 | Nyman | 16/158 |
| 3,710,415 | 1/1973 | Wilson | 16/158 |

FOREIGN PATENT DOCUMENTS

| | | | |
|---|---|---|---|
| 2409044 | 3/1975 | Fed. Rep. of Germany | 16/158 |

*Primary Examiner*—Doris L. Troutman

*Attorney, Agent, or Firm*—R. J. Renk

[57] ABSTRACT

A hinge arrangement whereby a closure member may be moved to different locations.

7 Claims, 7 Drawing Figures

HINGE ARRANGEMENT

BACKGROUND OF INVENTION

Heretofore cabinets and their closure members (such as doors), once assembled, have been relatively permanent in their arrangement. No flexibility was available to provide for open display areas and closed areas.

SUMMARY OF INVENTION

The present invention provides an arrangement whereby closures may be moved to various predetermined locations relative to a cabinet to provide for different open and closed storage areas, or the closures may be turned inside out to provide a decorator effect. The cabinet thus provides considerable flexibility in storage as well as appearance.

DRAWINGS

DESCRIPTION OF INVENTION

Figure 1:
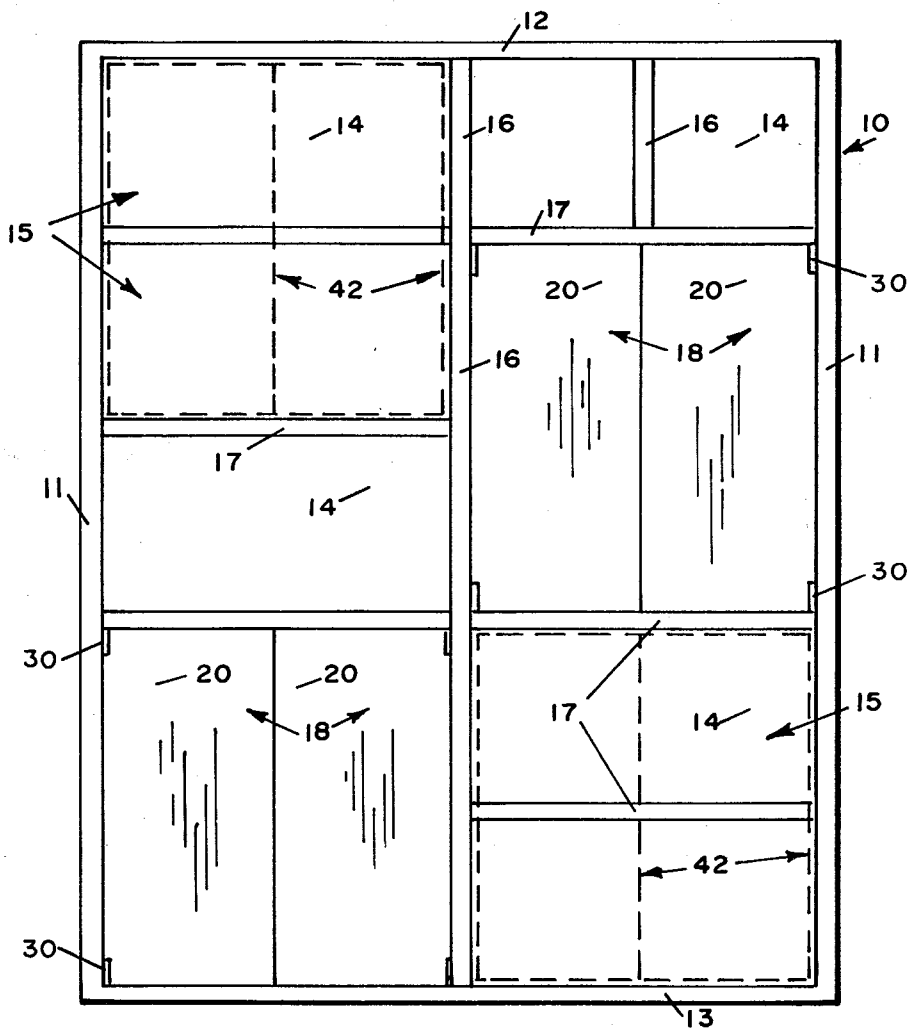
FIG. 1 is a front view of a cabinet made in accordance with the invention.

For purposes of general description, reference is made to FIG. 1 which shows a cabinet 10 having side walls 11, top and bottom walls 12 and 13 respectively, and a back wall 14. The cabinet is divided into a series of compartments 15 by vertical dividers 16 and shelves 17. The walls, shelves and dividers in effect provide a frame. Some of the compartments may be "closed" in by hinged closure or panel members such as doors 18.

For the storage of different articles, or to provide a "decorator" effect, it is sometimes desirable to change the location of the closure members 18 relative to the cabinet compartments.

In accordance with the present invention, the closure(s) 18 are removable. As may be seen in FIG. 2, the closures may be swingably secured to the cabinet by a hinge 19. Typically, the closure or door has the usual front face 20, inside face 21, side edges 22 and 23 respectively, and top and bottom edges 24 and 25 respectively.

Figure 2:
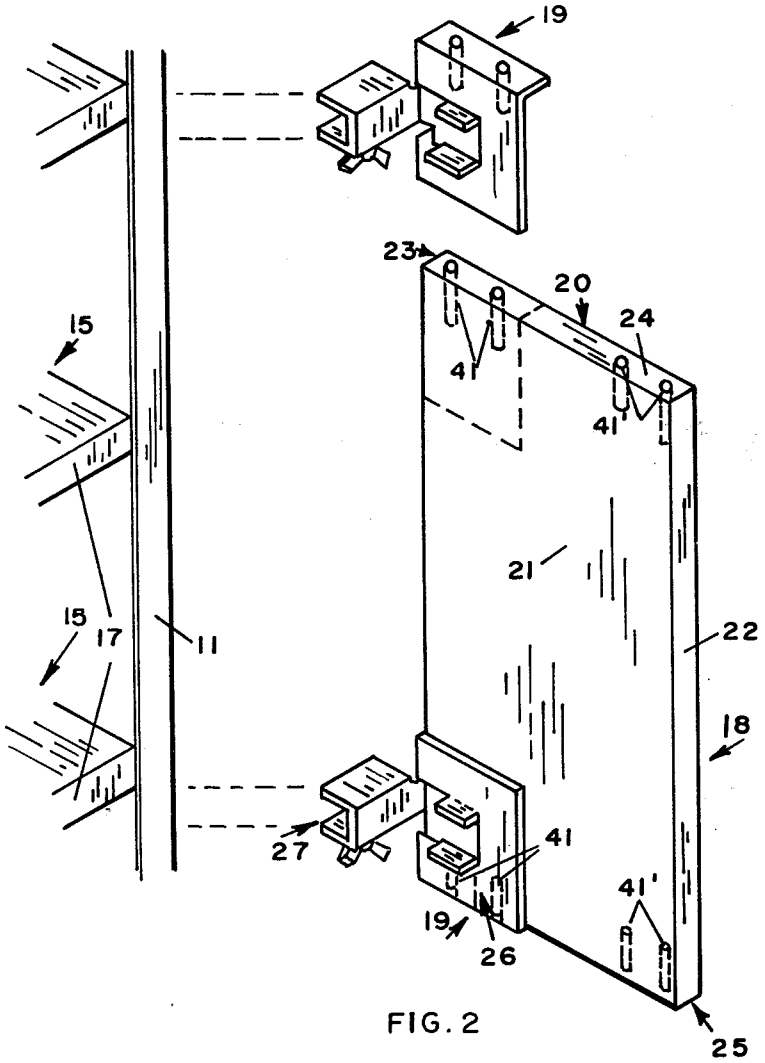
FIG. 2 is a partial perspective view of a cabinet showing a closure member and its associated hinge.
Figure 4:
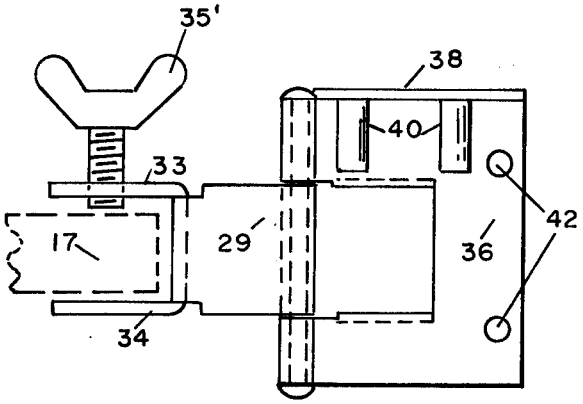
FIG. 4 is a front view of a hinge showing it in an "open" position.
Figure 3:
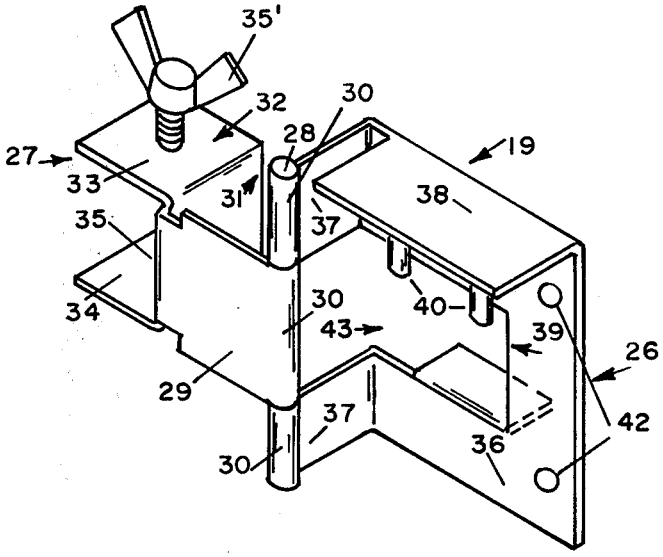
FIG. 3 is an enlarged perspective view of the hinge as shown in FIG. 2.

As will be specifically seen in FIGS. 2–6, the hinge 19 includes a base member 26 having first means including plates 36, 37, 38 and posts 40 for attachment to a closure 18 and second means including a bracket member 27 pivotally secured to the base by a pin 28 for attaching the hinge to a cabinet or frame. Bracket 27 includes an arm 29, a portion 30 of which is curled around the pin 28, and another portion 31 of which has a generally right angle bend and an integrally formed U-shaped clip 32 (FIG. 3).

For the purposes of attaching the hinge 19 to the cabinet, the clip 32 has a top leg 33 and a bottom leg 34 spaced apart by a base leg 35 to define a channel opening. The legs of the clip straddle a shelf 17 (FIG. 4) and the clip is held thereon by a thumb-screw 35'.

The other part of the hinge, namely the base 26 includes a face plate 36 (which is adapted to engage an inside face 21 of a closure adjacent a corner thereof), a side edge plate 37 at substantially right angles to the face plate 36, and a cap faceplate 38 which is turned inwardly in the same direction as the side edge plate 37 at right angles to the face plate 36. The inside surface of top plate 38 is adapted to engage either the top or bottom edge 24 or 25 of the closure 18. The plates 36, 37 and 38 thus define a pocket or nest indicated generally at 39 to engage three surfaces of the closure such as a front face 20, a side edge 2 and a bottom edge 25.

For attachment to a closure 18, the hinge base 26 has a series of upstanding posts 40 extending at right angles from the inside of cap plate 38. The posts are adapted to be inserted into complementary holes 41 (FIG. 2) in the top or bottom closure edges 24 and 25. The posts 40 and holes 41 together with the pocket nest 39 provide a retaining arrangement between the closure 18 and the hinge base 26. If desired, screws (not shown) may be inserted through holes 42 (FIGS. 3 and 4) of the hinge base 26 and into the closure.

For purposes of providing a "close" hinge effect, the base member 26 is notched out in the side edge plate 37 as indicated at 43 which notch extends into face plate 36. Actually takes the form of a right angle bend as it is cut out of the face plate sides 36 and 37. For hinging, the ends side edge of plate 37 are also curled around the pin 28 at 30' (FIGS. 3 and 7).

Figure 6:
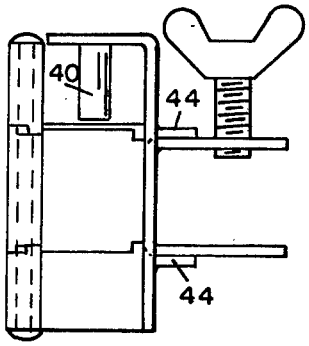
FIG. 6 is a side view of the hinge shown in FIG. 4 showing it in a closed position.
Figure 5:
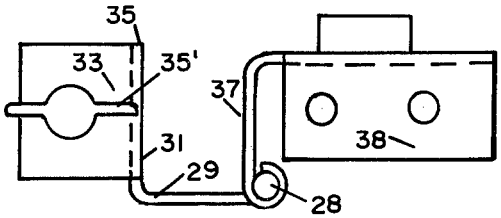
FIG. 5 is a top view of the hinge as shown in FIG. 4.
Figure 7:
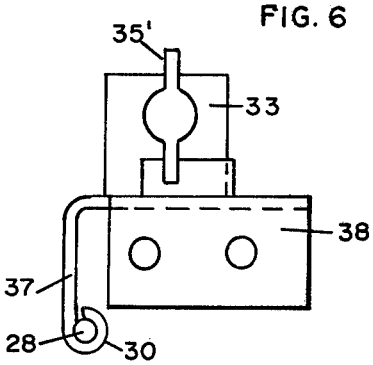
FIG. 7 is a top view of the hinge view shown in FIG. 6.

The purpose of the notch 43 is to allow the hinge arm 29 to nest therein when the hinge is in its closed position as shown in FIGS. 6 and 7. In other words, when a closure 18 is closed relative to the cabinet as shown in FIG. 1, it will be evident that the hinge will be substantially hidden when viewed from the front. As so viewed, the face plate 36 will be to the inside of the closure and plate 38 will be substantially obscured and generally only the hinge curled end 30' will show.

Now, in accordance with the invention, should a different decorator effect be desired, the closure panels 18 may have different colors or design effects on their opposed front and inside faces 20 and 21 respectively. In other words, the front face 20 and inside face 21 may be different in appearance. So, if it is desired to change the appearance of the cabinet, the respective hinges as shown in FIG. 2 may be reversed and placed on opposite side faces of the closure. The posts are then inserted in the holes 41'. This would then make the inside closure face 21 the front side.

As another feature of the invention, the position of the closures 18 can be changed from one side to the other or from one level to the other of the cabinet. To accomplish this, the shelves 17 are spaced at predetermined increments with respect to the height of the closures (i.e. spacing between the hinges 19). Thus, as shown in dotted lines 42 in FIG. 1, the closures may be moved to different positions by merely loosening the thumb screws 35' and re-locating the closures in the newly desired position and then re-tightening the thumb screws again. If desired, the thumb screws can of course be made to extend through the top leg 33 and bottom leg 34 of the clip 32 and thus through an appropriate opening in a shelf.

To aid in keeping the closures 18 in a closed position, (such as the hinge position of FIG. 6) tabs 44 may be bent to extend rearwardly from the face plate 36 (FIGS. 2–7). The tabs 44 frictionally engage the outer surfaces of the bracket legs 33 and 34 respectively and can be formed to vary the amount of frictional drag desired. If desireable, one tab may be used instead of two, or, in some cases tabs may not be desirable.

While one arrangement of shelving has been shown, the shelves 17 are spaced such that any number of shelves may be used except that their spacing is generally some divisor of the spacing between the hinges. In other words, the doors may be staggered by moving them up or down to another shelf position. From the disclosure, it will thus be seen that the closures may be inverted (turned inside out) to present a different face to the outside of the closure or, the closures may be rearranged with respect to one another and the cabinet. (The dotted lines showing possible closure locations are for purposes of illustration and do not necessarily coincide exactly with the changed position of the closures.)

What I claim is:

1. A hinge for attaching a closure to a frame wherein said frame includes a shelf member and said closure is adapted to be moved from an open to a closed position to generally obscure said shelf in said closed position and wherein said closure has an inside and an outside face and a series of edges comprising, a base adapted to be attached to said closure, said base having a face plate for engaging said inside face of said closure, said base also having a side plate which is adapted to engage an edge of said closure and another plate at substantially right angles to both said face plate and said side plate for engaging another edge of said closure, a bracket member including an arm, means carried by said arm for pivotally securing said bracket to said base, said bracket member also having means for engaging and attaching said bracket member to said shelf member, said means for pivotally securing said arm allowing said closure to be moved to a closed position to obscure at least a portion of said shelf member and place the inside of said closure and said face plate toward said shelf member to thereby obscure said face plate when said closure is viewed from the outside face thereof.

2. A hinge as claimed in claim 1 wherein said bracket includes a substantially "U"-shaped means which straddles the edge of said shelf member and is secured thereto by a fast disconnect means.

3. A hinge as claimed in claim 1 wherein said base includes means fixedly secured thereto which extends into a side edge of said closure.

4. A hinge as claimed in claim 29 wherein tab means extends outwardly from said base and is adapted to slideably engage said bracket member to frictionally hold the base and bracket member together in one position thereof.

5. A hinge for attaching a closure to a frame wherein said frame includes a shelf member and said closure is adapted to be moved from an open to a closed position to generally obscure said shelf in said closed position and wherein said closure has an inside and an outside face and a series of edges comprising, a base having means for attachment to said closure, a bracket member including an arm, means carried by said arm for pivotally securing said bracket member to said base, said bracket member also having means for engaging and attaching said bracket member to said shelf member, said means for pivotally securing said arm allowing said closure to be moved to a closed position to thereby obsure at least a portion of said shelf member and place the inside of said closure toward said shelf member.

6. A hinge for attaching a closure to a frame wherein said closure is adapted to be moved from an open to a closed position and wherein said closure has an inside and an outside face and a series of edges comprising, a base adapted to be attached to said closure, a bracket member including an arm, means carried by said arm for pivotally securing said bracket member to said base to thereby allow said closure to be moved between said open and closed positions, said bracket member also having means for attachment to said frame, and means for releaseably retaining said closure in said closed position, said means including means carried by said base which frictionally engages means carried by said bracket member which slideably release from one another in said open position and engage one another in said closed position.

7. A hinge as claimed in claim 32 wherein said means for releasably retaining said closure in said closed position includes tab means extending from said base which engages said bracket member.

* * * * *